US009224347B2

(12) United States Patent
Han

(10) Patent No.: US 9,224,347 B2
(45) Date of Patent: Dec. 29, 2015

(54) TFT-LCD DRIVING CIRCUIT

(75) Inventor: Seung Woo Han, Beijing (CN)

(73) Assignee: BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 1286 days.

(21) Appl. No.: 12/881,391

(22) Filed: Sep. 14, 2010

(65) Prior Publication Data

US 2011/0063278 A1 Mar. 17, 2011

(30) Foreign Application Priority Data

Sep. 16, 2009 (CN) ..... 2009 1 0093017

(51) Int. Cl.
*G09G 3/36* (2006.01)

(52) U.S. Cl.
CPC ..... *G09G 3/3611* (2013.01); *G09G 3/3674* (2013.01); *G09G 2310/08* (2013.01); *G09G 2320/0209* (2013.01)

(58) Field of Classification Search
CPC . G09G 3/3611; G09G 3/3674; G09G 3/3677; G09G 3/3681; G09G 2310/08; G09G 2320/0257
USPC ..... 345/92, 212, 213
See application file for complete search history.

(56) References Cited

U.S. PATENT DOCUMENTS 4,074,256 A * 2/1978 Sekiya et al. ..... 345/49
5,859,635 A 1/1999 Hang et al.
7,176,874 B2 2/2007 Furukoshi
7,466,312 B2 12/2008 Choi et al.
7,522,160 B2 4/2009 Moon
7,605,793 B2 10/2009 Lee
8,085,261 B2 12/2011 Fang et al.
8,089,446 B2 1/2012 Pak et al.
8,232,941 B2 7/2012 Yeo et al.
2004/0125061 A1 7/2004 Furukoshi (Continued)

FOREIGN PATENT DOCUMENTS

CN 1581256 A 2/2005
CN 101136160 A 3/2008

(Continued)

OTHER PUBLICATIONS

USPTO FOA dated May 9, 2014 in connection with U.S. Appl. No. 13/329,534.

(Continued)

*Primary Examiner* — Dwayne Bost
*Assistant Examiner* — Stefan M Oehrlein
(74) *Attorney, Agent, or Firm* — Ladas & Parry LLP

(57) ABSTRACT

A TFT-LCD driving circuit is disclosed. The TFT-LCT driving circuit comprises input terminals, output terminals, and a processing circuit connected between the input terminals and the output terminals, for processing a CPV signal, an OE1 signal, an OE2 signal, and a STV signal, so that a set time interval exists between a falling edge of the output CLK signal and a rising edge of the CLKB signal in one cycle of the CLK signal, or that the set time interval exists between a rising edge of the output CLK signal and a falling edge of the CLKB signal in one cycle of the CLKB signal. Confusion of data input to pixel electrodes due to delays of gate driving signals may be avoided by the TFT-LCD driving circuit.

5 Claims, 6 Drawing Sheets

(56) References Cited

U.S. PATENT DOCUMENTS

| | | | | |
|---|---|---|---|---|
| 2005/0035958 | A1* | 2/2005 | Moon | 345/204 |
| 2005/0104647 | A1 | 5/2005 | Choi et al. | |
| 2006/0103619 | A1* | 5/2006 | Kim | 345/98 |
| 2006/0290637 | A1* | 12/2006 | Kang et al. | 345/98 |
| 2007/0139339 | A1 | 6/2007 | Kim et al. | |
| 2008/0036717 | A1 | 2/2008 | Moon | |
| 2008/0055225 | A1 | 3/2008 | Pak et al. | |
| 2008/0055282 | A1* | 3/2008 | Lee | 345/204 |
| 2008/0080661 | A1 | 4/2008 | Tobita | |
| 2008/0084378 | A1 | 4/2008 | Lee et al. | |
| 2008/0117157 | A1* | 5/2008 | Hwang et al. | 345/92 |
| 2008/0136756 | A1 | 6/2008 | Yeo et al. | |
| 2008/0165169 | A1 | 7/2008 | Lee | |
| 2008/0192032 | A1 | 8/2008 | Park et al. | |
| 2008/0218502 | A1 | 9/2008 | Lee et al. | |
| 2009/0009497 | A1 | 1/2009 | Lee et al. | |
| 2009/0021502 | A1 | 1/2009 | Lee et al. | |
| 2010/0182305 | A1 | 7/2010 | Fang et al. | |
| 2010/0303195 | A1 | 12/2010 | Wang | |
| 2011/0063278 | A1 | 3/2011 | Han | |
| 2012/0162054 | A1* | 6/2012 | Wang | 345/92 |

FOREIGN PATENT DOCUMENTS

| | | | |
|---|---|---|---|
| CN | 101187743 | A | 5/2008 |
| CN | 101221818 | A | 7/2008 |
| CN | 101261412 | A | 9/2008 |
| CN | 101303838 | A | 11/2008 |

OTHER PUBLICATIONS

USPTO NFOA dated Aug. 29, 2014 in connection with U.S. Appl. No. 13/329,534.

* cited by examiner

TFT-LCD DRIVING CIRCUIT

BACKGROUND

The present invention relates to a Thin Film Transistor Liquid Crystal Display (TFT-LCD) driving circuit.

A schematic structural diagram of a TFT-LCD driving circuit in the prior art is as shown in FIG. 1. A timing controller 1 is used to generate various control signals, such as a gate line sync signal (generally referred to as CPV (Clock Pulse Vertical) signal in the art), a gate line start signal (generally referred to as STV (Start Vertical) signal in the art), a gate line output control signal (generally referred to as OE1 (Output Enable) signal in the art), and a signal (generally referred to as OE2 signal in the art) required by a Multi Level Gateway (MLG) gate driving signal. The timing controller 1 inputs the generated various control signals into a High Voltage TFT-LCD Logic Driver 2, which generates a first clock signal (generally referred to as CLK signal in the art), a second clock signal (generally referred to as CLKB signal in the art), and an improved STV signal (generally referred to as STVP signal in the art) from the CPV signal, the STV signal, the OE1 signal, the OE2 signal, and so on. The improved STV signal refers to a STV signal whose level has been adjusted, because the level of the STV signal output from the timing controller may be not consistent with that of a STV signal required by a gate driving circuit, and the level of the STV signal output from the timing controller has to be converted by some level conversion circuits. The CLKB signal, the CLK signal and the STVP signal are input to the gate driving circuit, thus the gate lines may be driven to operate.

A timing diagram for a TFT-LCD driving circuit in the prior art is as shown in FIG. 2*a*, which shows a timing relationship between the STV signal, the CPV signal, the OE1 signal and the OE2 signal and gate driving signals output by the gate driving circuit (FIG. 2*a* only shows two gate driving signals, GATE1 and GATE2, which are gate driving signals respectively used to drive a first row of gate lines and a second row of gate lines).

A timing diagram for another TFT-LCD driving circuit in the prior art is as shown in FIG. 2*b*, which shows a timing relationship between the STV signal, the CPV signal and the OE2 signal and gate driving signals output by the gate driving circuit (FIG. 2*b* only shows two gate driving signals, GATE1 and GATE2, which are gate driving signals respectively used to drive a first row of gate lines and a second row of gate lines).

Differences between FIG. 2*a* and FIG. 2*b* lie in that in FIG. 2*a*, the OE1 signal is used, and the gate driving signals are started to be output from falling edges of the OE1 signal; whereas in FIG. 2*b*, the OE1 signal is not used, and the gate driving signals are started to be output from falling edges of the OE2 signal.

In the TFT-LCD driving circuit, generally, when the gate driving circuit outputs a gate driving signal for turning on a row of gate lines, a source driving circuit inputs data signals for respective pixels to which the row of gate lines correspond into respective pixel electrodes of the row. A schematic diagram of an ideal timing relationship between gate driving signals of a TFT-LCD and data signals input by a source driving circuit in the prior art is as shown in FIG. 3. When the gate driving signals are at a high level, the source driving circuit inputs the data signals into pixel electrodes.

FIG. 3 shows the ideal timing relationship. However, in actual applications, both rising edges and falling edges of the gate driving signals have certain time delays. A schematic diagram of an actual timing relationship between gate driving signals of a TFT-LCD and data signals input by a source driving circuit in the prior art is as shown in FIG. 4. If the time delays of the gate driving signals are relatively significant, the gate driving signal GATE2 for the second row has started to rise when the gate driving signal GATE1 for the first row is just at a falling edge, then the source driving circuit has already input data to which a second row of pixels correspond while respective TFTs to which the first row of gate lines correspond are not yet turned off, thus the data input to a first row of pixels are confused, and thereby affecting picture display.

For a Gate Driver on Array (GOA) panel, electrons in TFTs therein have a low moving speed, and the data confusion caused by the delays of the gate driving signals will be more severe.

SUMMARY

An embodiment of the invention, in view of the above problems in the prior art, provides a TFT-LCD driving circuit which can avoid the confusion of data input into pixel electrodes caused by delays of gate driving signals.

The TFT-LCD driving circuit comprises input teiminals for inputting a CPV signal, an OE1 signal, an OE2 signal, and a STV signal, output terminals for outputting a CLK signal and a CLKB signal, and a processing circuit connected between the input terminals and the output terminals, for processing the CPV signal, the OE1 signal, the OE2 signal, and the STV signal, so that a set time interval exists between a falling edge of the output CLK signal and a rising edge of the CLKB signal in one cycle of the CLK signal, or that the set time interval exists between a rising edge of the output CLK signal and a falling edge of the CLKB signal in one cycle of the CLKB signal.

In the TFT-LCD driving circuit, the input terminals may include a CPV signal input terminal for inputting the CPV signal, an OE1 signal input terminal for inputting the OE1 signal, an OE2 signal input terminal for inputting the OE2 signal, and a STV signal input terminal for inputting the STV signal.

The output terminals may include a CLK signal output terminal for outputting the CLK signal, and a CLKB signal output terminal for outputting the CLKB signal.

The processing circuit may include a charge sharing control module and a control signal conversion module.

The charge sharing control module is connected to the input terminals, for receiving the CPV signal, the OE1 signal, the OE2 signal, and the STV signal, performing an OR processing on the OE1 signal and the OE2 signal, and performing a NOT processing on the STV signal.

The control signal conversion module is connected to the charge sharing control module and the output terminals respectively, for receiving a processing result of the charge sharing control module, and generating the CLK signal and the CLKB signal by a AND processing, a NOT processing, an NAND processing, and a time delay processing, wherein the set time interval exists between the falling edge of the CLK signal and the rising edge of the CLKB signal in one cycle of the CLK signal, or the set time interval exists between the rising edge of the CLK signal and the falling edge of the CLKB signal.

The processing circuit may also include a first OR gate, a first NOT gate, a first NAND gate, a first NOR gate, a second NOT gate, a third NOT gate, a fourth NOT gate, a fifth NOT gate, a D flip-flop, a first AND gate, a second AND gate, a third AND gate, and a second OR gate;

input terminals of the first OR gate are connected with the OE1 signal input terminal and the OE2 signal input terminal, respectively;

an input terminal of the first NOT gate is connected with the STV signal input terminal;

input terminals of the first NAND gate are connected with an output terminal of the first OR gate and an output terminal of the first NOT gate, respectively;

input terminals of the first NOR gate are connected to the CPV signal input terminal and an output terminal of the first NAND gate, respectively;

an input terminal of the second NOT gate is connected with the output terminal of the first OR gate;

an input terminal of the third NOT gate is connected with an output terminal of the first NOR gate;

a CP input terminal of the D flip-flop is connected with an output terminal of the third NOT gate;

an input terminal of the fourth NOT gate is connected with the STV signal input terminal, and an output terminal of the fourth NOT gate is connected with a CLRN input terminal of the D flip-flop;

an input terminal of the fifth NOT gate is connected with a Q output terminal of the D flip-flop, and an output terminal of the fifth NOT gate is connected with a D input terminal of the D flip-flop;

input terminals of the first AND gate are connected with an output terminal of the second NOT gate and the output terminal of the fifth NOT gate, respectively, and an output terminal of the first AND gate is connected with the CLK signal output terminal;

input terminals of the second AND gate are connected with the output terminal of the second NOT gate and the Q output terminal of the D flip-flop, respectively;

input terminals of the third AND gate are connected with the STV signal input terminal and the output terminal of the first NOR gate, respectively;

input terminals of the second OR gate are connected with an output terminal of the second AND gate and an output terminal of the third AND gate, respectively, and an output terminal of the second OR gate is connected with the CLKB signal output terminal.

Based on the above technical solution, the TFT-LCD driving circuit may further comprise an amplifying circuit;

the output terminals for outputting the CLK signal and CLKB signal may further include a STVP signal output terminal for outputting a STV signal and an amplified OE2 signal output terminal for outputting an amplified OE2 signal;

the output terminal of the first AND gate and the CLK signal output terminal are both connected with the amplifying circuit;

the output terminal of the second OR gate and the CLKB signal output terminal are both connected with the amplifying circuit;

the STV signal output terminal and the STVP signal output terminal are both connected with the amplifying circuit; and the OE2 signal input terminal and the amplified OE2 signal output terminal are both connected with the amplifying circuit.

The TFT-LCD circuit provided by the embodiment of the invention may generate the CLK signal and the CLKB signal from the STV signal, the OE1 signal, the OE2 signal, and the CPV signal in the prior art, and for the CLK signal and the CLKB signal generated by the circuit, the falling edge of the CLK signal and the rising edge of the CLKB signal may be staggered by a certain time interval in one cycle of the CLK signal, or the falling edge of the CLKB signal and the rising edge of the CLK signal may be staggered by the certain time interval in one cycle of the CLKB signal, so that the confusion of data input to pixel electrodes caused by delays of gate driving signals may be avoided.

Hereinafter, a further description of technical solutions of the invention will be made in detail with reference to attached drawings and embodiments.

DETAILED DESCRIPTION OF THE EMBODIMENTS

An embodiment of the invention provides a TFT-LCD driving circuit, comprising input terminals for inputting a CPV signal, an OE1 signal, an OE2 signal, and a STV signal, output terminals for outputting a CLK signal and a CLKB signal, and a processing circuit connected between the input terminals and the output terminals, for processing the CPV signal, the OE1 signal, the OE2 signal, and the STV signal, so that a set time interval exists between a falling edge of the output CLK signal and a rising edge of the CLKB signal in one cycle of the CLK signal, or that a set time interval exists between a rising edge of the output CLK signal and a falling edge of the CLKB signal in one cycle of the CLKB signal.

In the TFT-LCD driving circuit, input terminals may include a CPV signal input terminal for inputting the CPV signal, an OE1 signal input terminal for inputting the OE1 signal, an OE2 signal input terminal for inputting the OE2 signal, and a STV signal input terminal for inputting the STV signal.

The output terminals may include a CLK signal output terminal for outputting the CLK signal, and a CLKB signal output terminal for outputting the CLKB signal.

The processing circuit may include a charge sharing control module and a control signal conversion module.

The charge sharing control module is connected to the input terminals, for receiving the CPV signal, the OE1 signal, the OE2 signal, and the STV signal, performing an OR processing on the OE1 signal and the OE2 signal, and performing a NOT processing on the STV signal.

The control signal conversion module is connected to the charge sharing control module and the output terminals respectively, for receiving a processing result of the charge sharing control module, and generating the CLK signal and the CLKB signal by a AND processing, a NOT processing, an NAND processing, and a time delay processing, wherein the set time interval exists between the falling edge of the CLK signal and the rising edge of the CLKB signal in one cycle of the CLK signal, or the set time interval exists between the rising edge of the CLK signal and the falling edge of the CLKB signal in one cycle of the CLKB signal.

Figure 1:
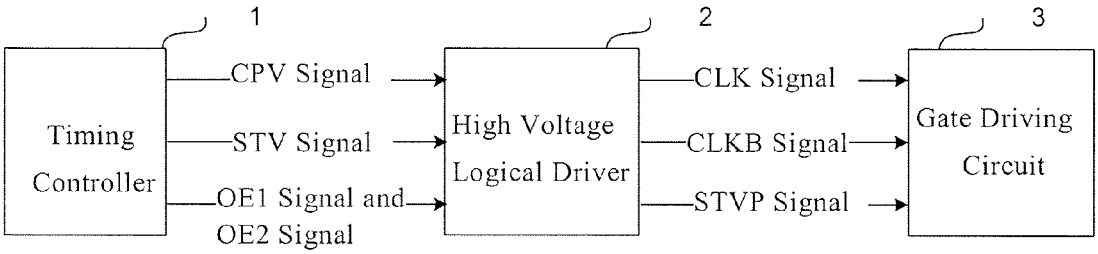
Fig.1 (Prior Art)
FIG. 1 shows a schematic structural diagram of a TFT-LCD driving circuit in the prior art.
Figure 2A:
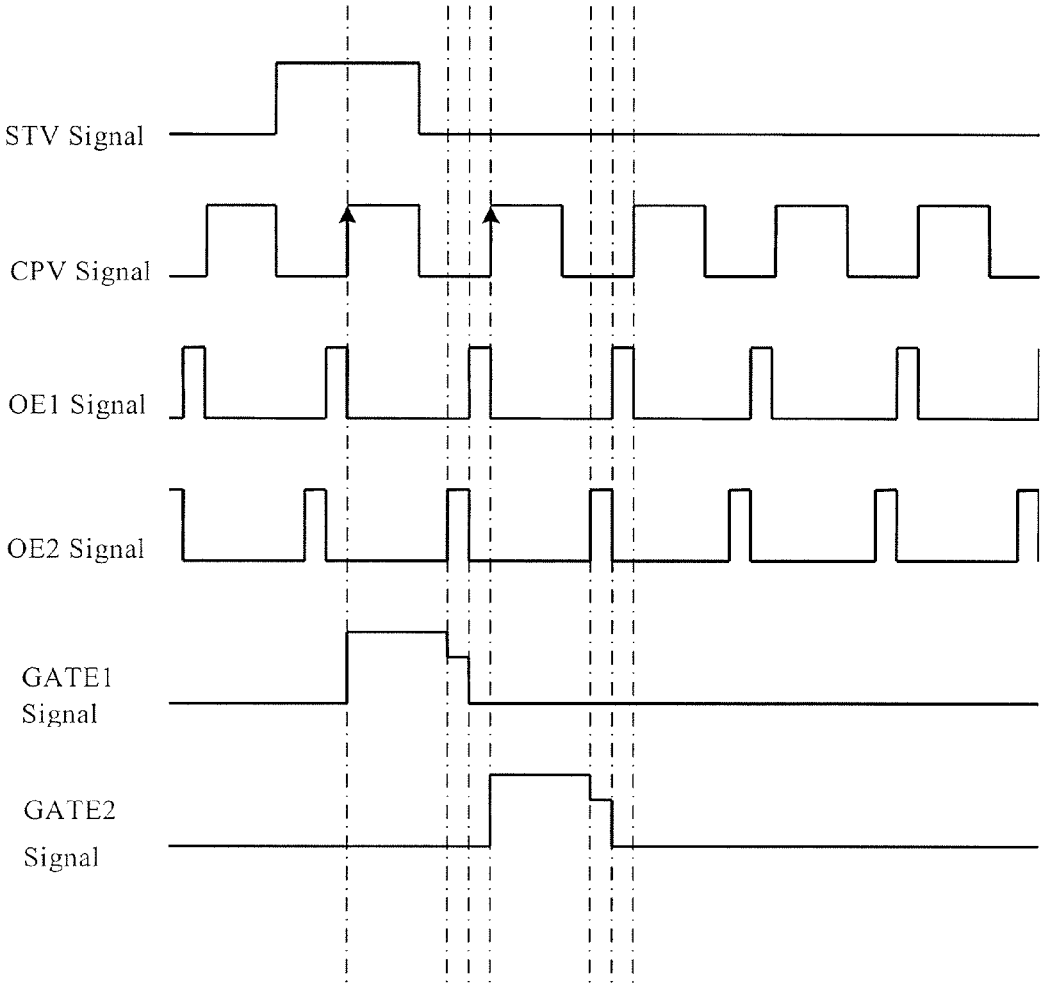
Fig.2a (Prior Art)
FIG. 2*a* shows a timing diagram of a TFT-LCD driving circuit in the prior art.
Figure 2B:
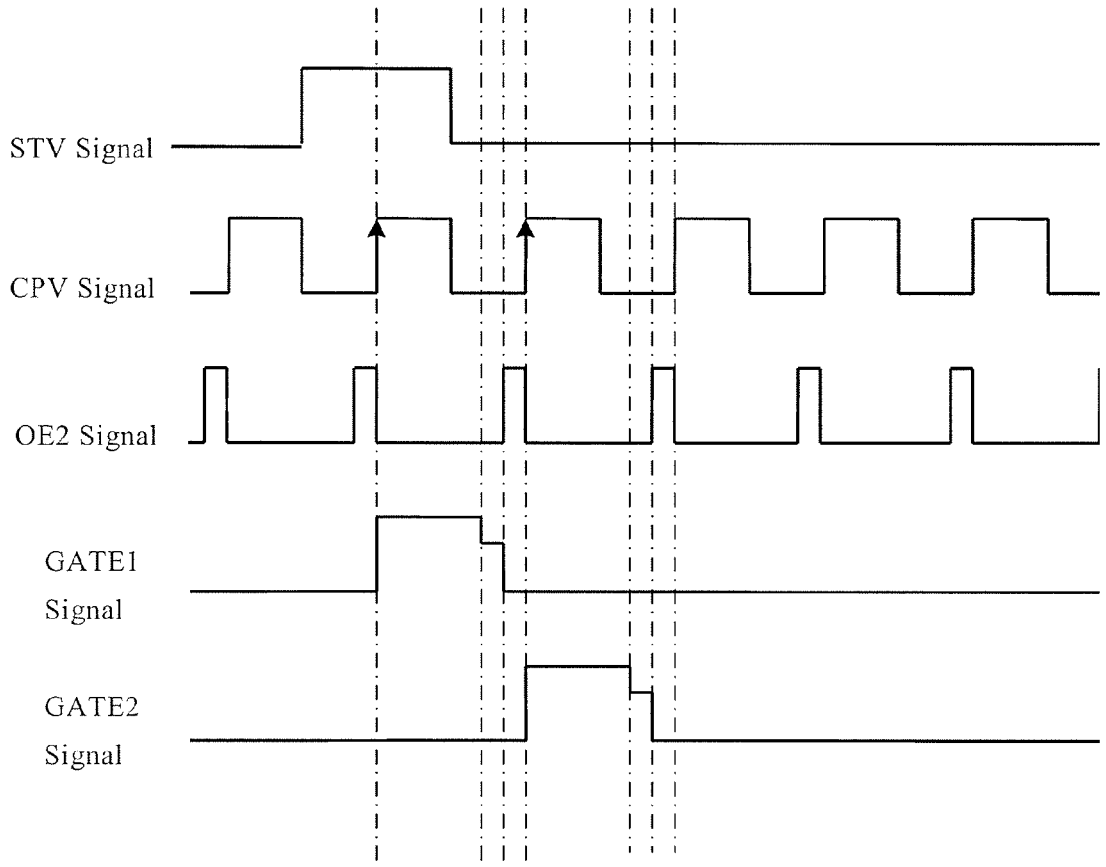
Fig.2b (Prior Art)
FIG. 2*b* shows a timing diagram of another TFT-LCD driving circuit in the prior art.
Figure 3:
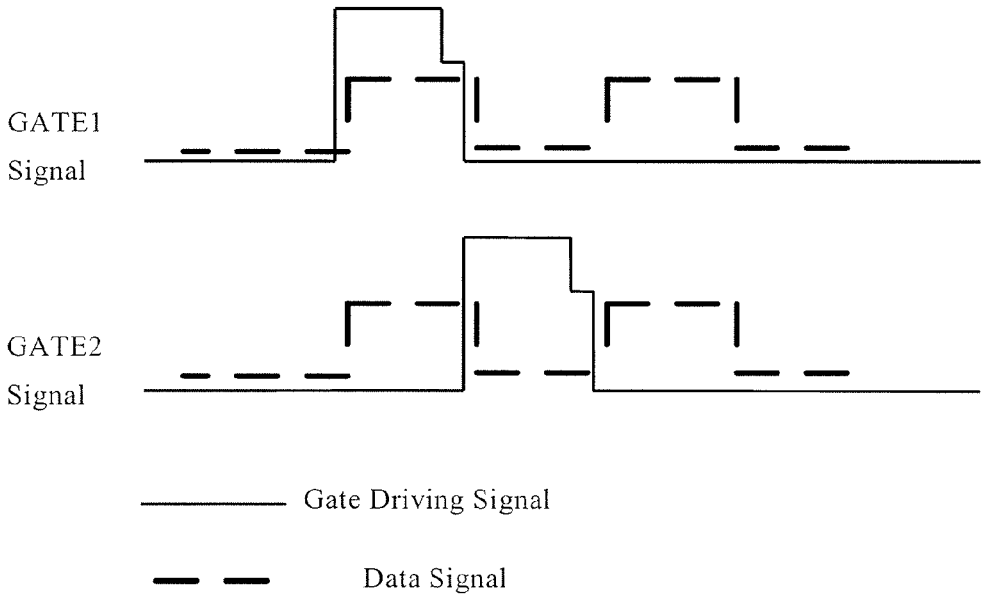
Fig.3 (Prior Art)
FIG. 3 shows a schematic diagram of an ideal timing relationship between gate driving signals of a TFT-LCD and data signals input by a source driving circuit in the prior art.
Figure 4:
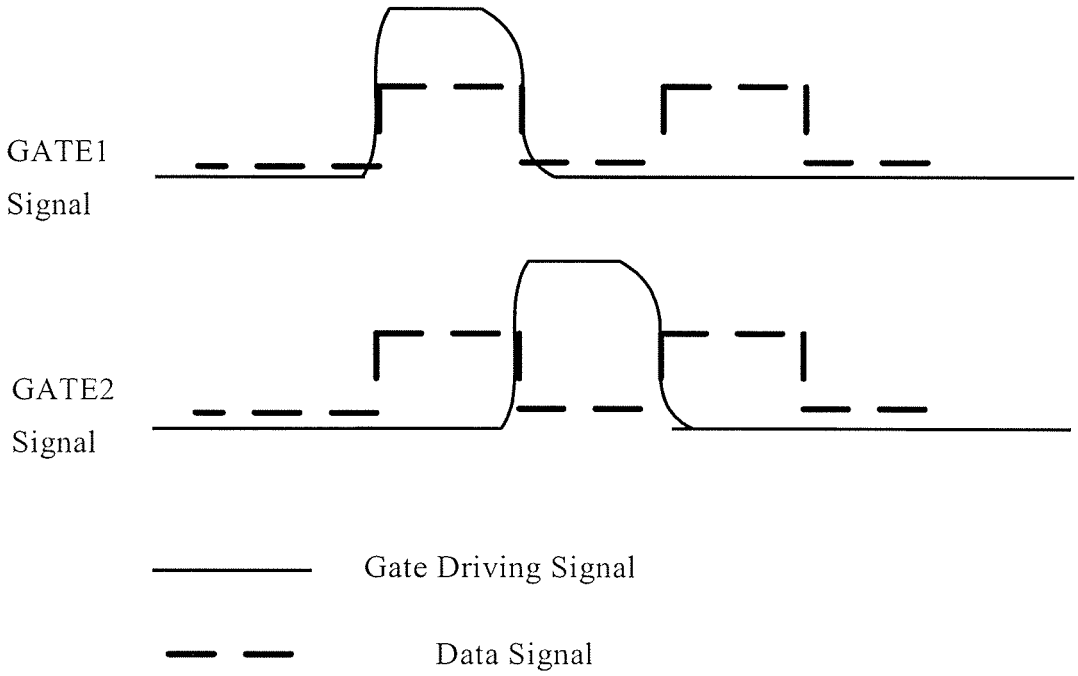
Fig.4 (Prior Art)
FIG. 4 shows a schematic diagram of an actual timing relationship between gate driving signals of a TFT-LCD and data signals input by a source driving circuit in the prior art.
Figure 5:
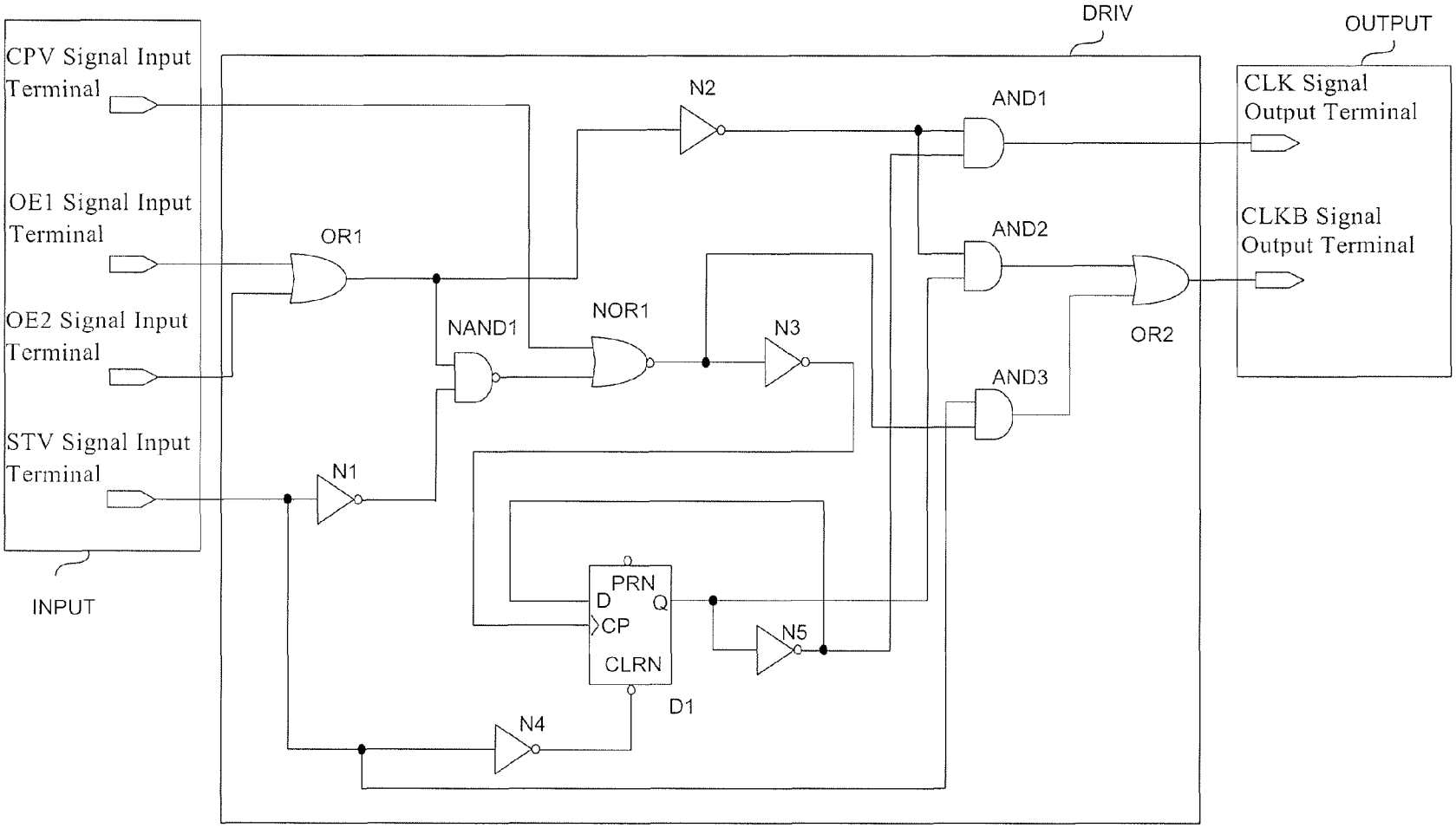
FIG. 5 shows a schematic structural diagram of a TFT-LCD driving circuit according to a first embodiment of the invention.

A schematic structural diagram of a TFT-LCD driving circuit according to a first embodiment of the invention is as shown in FIG. 5. Input terminals INPUT include a CPV signal input terminal, an OE1 signal input terminal, an OE2 signal input terminal, and a STV signal input terminal. Output terminals OUTPUT include a CLK signal output terminal and a CLKB signal output terminal.

A processing circuit DRIV includes a first OR gate OR1, a first NOT gate N1, a first NAND gate NAND1, a first NOR gate NOR1, a second NOT gate N2, a third NOT gate N3, a fourth NOT gate N4, a fifth NOT gate N5, a D flip-flop D1, a first AND gate AND1, a second AND gate AND2, a third AND gate AND3, and a second OR gate OR2;

input terminals of the first OR gate OR1 are connected with the OE1 signal input terminal and the OE2 signal input terminal, respectively;

an input terminal of the first NOT gate N1 is connected with the STV signal input terminal;

input terminals of the first NAND gate NAND1 are connected with an output terminal of the first OR gate OR1 and an output terminal of the first NOT gate N1, respectively;

input terminals of the first NOR gate NOR1 are connected to the CPV signal input terminal and an output terminal of the first NAND gate AND1, respectively;

an input terminal of the second NOT gate N2 is connected with the output terminal of the first OR gate OR1;

an input terminal of the third NOT gate N3 is connected with an output terminal of the first NOR gate NOR1;

a CP input terminal of the D flip-flop D1 is connected with an output terminal of the third NOT gate N3;

an input terminal of the fourth NOT gate N4 is connected with the STV signal input terminal, and an output terminal of the fourth NOT gate N4 is connected with a CLRN input terminal of the D flip-flop D1;

an input terminal of the fifth NOT gate N5 is connected with a Q output terminal of the D flip-flop D1, and an output terminal of the fifth NOT gate N5 is connected with a D input terminal of the D flip-flop D1;

input terminals of the first AND gate AND1 are connected with an output terminal of the second NOT gate N2 and the output terminal of the fifth NOT gate N5, respectively, and an output terminal of the first AND gate AND1 is connected with the CLK signal output terminal;

input terminals of the second AND gate AND2 are connected with the output terminal of the second NOT gate N2 and the Q output terminal of the D flip-flop D1, respectively;

input terminals of the third AND gate AND3 are connected with the STV signal input terminal A4 and the output terminal of the first NOR gate N1, respectively; and input terminals of the second OR gate OR2 are connected with an output terminal of the second AND gate AND2 and an output terminal of the third AND gate AND3, respectively, and an output terminal of the second OR gate OR2 is connected with the CLKB signal output terminal.

The CLRN input terminal, the PRN input terminal, the CP input terminal, the D input terminal, and the Q output terminal of the D flip-flop D1 in FIG. 5 are all well known terms in the electronic circuit field, and thus are not explained in detail in the invention.

Operating principles of the TFT-LCD driving circuit of the embodiment of the invention will be illustrated below.

In FIG. 5, the CLK signal is obtained by performing an OR operation on the OE1 signal and the OE2 signal by the first OR gate OR1, and then passing the result through the second NOT gate N2 and the first AND gate AND1. A signal output from the output terminal of the fifth NOT gate N5 is fed back to the D input terminal of the D flip-flop, so that the cycle of the output CLK signal and the cycle of the output CLKB signal are twice of that of the CPV signal.

Figure 6:
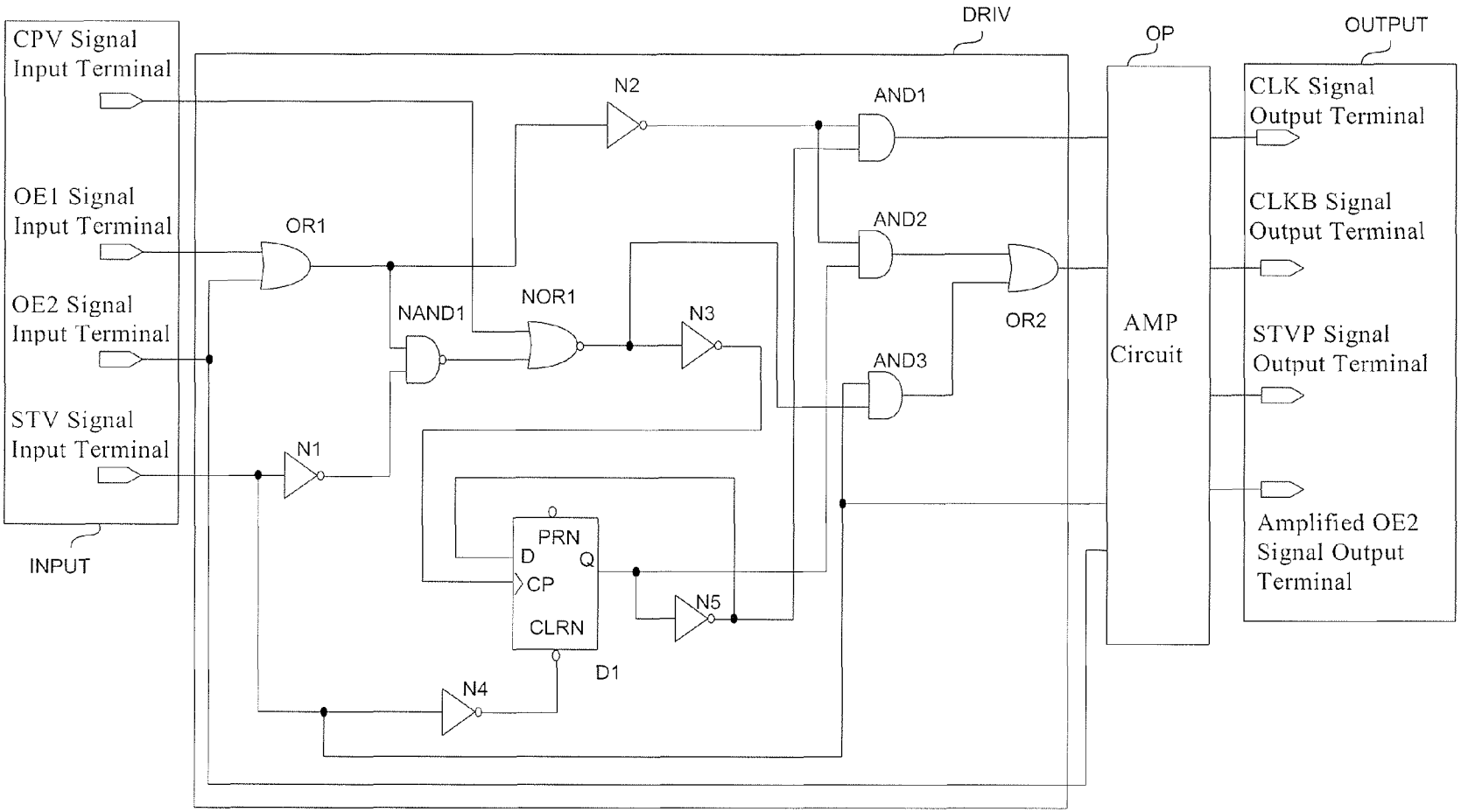
FIG. 6 shows a schematic structural diagram of a TFT-LCD driving circuit according to a second embodiment of the invention.

A schematic structural diagram of a TFT-LCD driving circuit according to a second embodiment of the invention is as shown in FIG. 6. As compared with the first embodiment, the second embodiments further comprises an amplifying circuit OP, and the output terminals OUTPUT further include a STVP signal output terminal and an amplified OE2 signal output terminal. The output terminal of the first AND gate AND1 and the CLK signal output terminal are both connected with the amplifying circuit OP; the output terminal of the second OR gate OR2 and the CLKB signal output terminal are both connected with the amplifying circuit OP; the STV signal output terminal and the STVP signal output terminal are both connected with the amplifying circuit OP; and the OE2 signal input terminal and the amplified OE2 signal output terminal are both connected with the amplifying circuit OP.

In the second embodiment, the amplifying circuit amplifies the generated CLK signal and CLKB signal, and amplifies the STV signal and the OE2 signal input from the processing circuit, so that levels of the respective signals may meet requirements of the GOA panel.

Further, the charge shared control module involved in the aforesaid embodiment may include the first OR gate OR1 and the first NOT gate N1 in the embodiment as shown in FIG. 5, and the control signal conversion module may include the first NOR gate NOR1, the second NOT gate N2, the third NOT gate N3, the fourth NOT gate N4, the fifth NOT gate N5, the D flip-flop D1, the first AND gate AND1, the second AND gate AND2, the third AND gate AND3, and the second OR gate OR2.

Figure 7A:
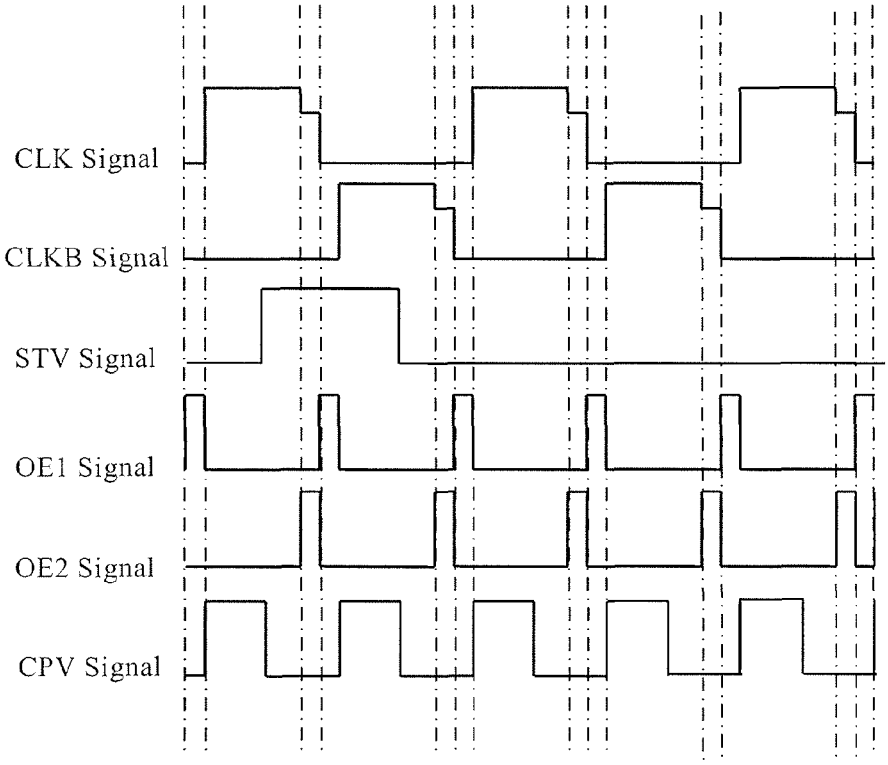
FIG. 7*a* shows a timing diagram of a TFT-LCD driving circuit of the embodiment of the invention.

A timing diagram of the TFT-LCD driving circuit of the embodiment of the invention is as shown in FIG. 7*a*. The STV signal, the OE1 signal, the OE2 signal, and the CPV signal are input signals, and the CLK signal and the CLKB signal are output signals. Generally, one gate driving signal will be output at each of a rising edge of the CLK signal and a rising edge of the CLKB signal, the CLK signal and the CLKB signal have the same cycle, and the rising edges thereof appear alternately, thus gate driving signals for respective rows of gate lines may be output in sequence. It can be seen from FIG. 7*a* that, falling edges of the OE1 signal correspond to rising edges of the CLK signal or the CLKB signal, and in one cycle of the CLK signal, the falling edge of the CLK signal and the rising edge of the CLKB signal are staggered by a time period that the OE1 signal remains high level in one cycle; and in one cycle of the CLKB signal, falling edge of the CLKB signal and rising edge of the CLK signal are also staggered by the time period that OE1 signal remains high level in one cycle, which is equivalent to masking the delays of the CLK signal or the CLKB signal by the OE1 signal, thus data confusion will not occur even if the gate driving signals are delayed due to the delays of the CLK signal and the CLKB signal.

Figure 7B:
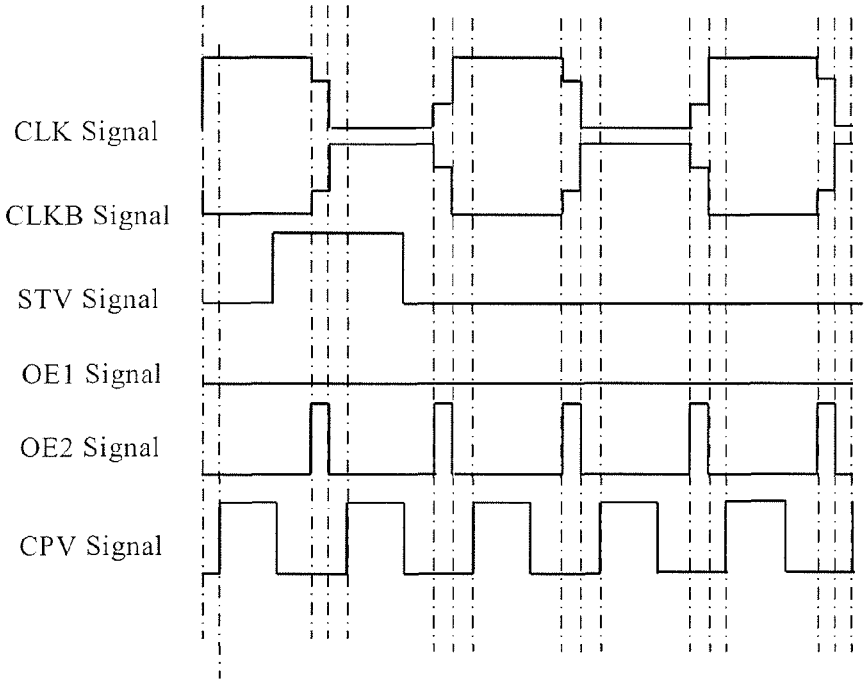
FIG. 7*b* shows another timing diagram of a TFT-LCD driving circuit of the embodiment of the invention.

In the timing diagram shown in FIG. 7*a*, the OE1 signal and the OE2 signal are used. The OE1 signal may be not used. Another timing diagram of a TFT-LCD driving circuit of the embodiment of the invention is as shown in FIG. 7*b*. In this figure, the OE1 signal always remains at a low level, and the output CLK signal and CLKB signal are two signals with inverted phases, thus charge sharing can be realized, that is, a high-level signal of the CLK signal may be discharged to the CLKB signal, so that rising time of the CLKB signal is shortened, accordingly rising time of the gate driving signal is shortened, the high-level signal of the CLK signal may also be discharged as soon as possible to shorten the falling time of the gate driving signal, and the effect of avoiding data confusion may also be achieved.

The TFT-LCD circuit provided by the embodiment of the invention may generate the CLK signal and the CLKB signal from the STV signal, the OE1 signal, the OE2 signal, and the CPV signal in the prior art, and for the CLK signal and the CLKB signal generated by the circuit, the falling edge of the CLK signal and the rising edge of the CLKB signal may be staggered by a certain time interval in one cycle of the CLK signal, or the falling edge of the CLKB signal and the rising edge of the CLK signal may be staggered by the certain time interval in one cycle of the CLKB signal, so that confusion of data input to pixel electrodes due to delays of gate driving signals may be avoided.

Finally, it is to be explained that the above embodiments are only used to illustrate, instead of limiting, technical solutions of the invention; although the invention is illustrated in detail with reference to embodiments thereof, it is to be understood by those of ordinary skill in the art that modifications or equivalent substitutions may still be made to the technical solutions of the invention, without departing the sprite and scope of the technical solution of the invention

What is claimed is:

1. A TFT-LCD driving circuit, comprising:

input terminals for inputting a CPV signal, an OE1 signal, an OE2 signal and a STV signal, output terminals for outputting a CLK signal and a CLKB signal, and a processing circuit connected between the input terminals and the output terminals, for processing the CPV signal, the OE1 signal, the OE2 signal, and the STV signal, so that a set time interval exists between a falling edge to the far right of the output CLK signal and a rising edge of the CLKB signal in one cycle of the CLK signal, or that the set time interval exists between a rising edge of the output CLK signal and a falling edge to the far right of the CLKB signal in one cycle of the CLKB signal, wherein a length of the set time interval equals to a length of a time interval that the OE1 signal remains at a high level in one cycle, wherein the processing circuit includes a charge sharing control module and a control signal conversion module, the charge sharing control module is connected to the input terminals, for receiving the CPV signal, the OE1 signal, the OE2 signal, and the STV signal, performing an OR processing on the OE1 signal and the OE2 signal, and performing a NOT processing on the STV signal; and the control signal conversion module is connected to the charge sharing control module and the output terminals respectively, for receiving the CPV signal, a processing result of performing the OR processing on the OE1 signal and the OE2 signal, and a processing result of performing the NOT processing on the STV signal from the charge sharing control module, and generating the CLK signal and the CLKB signal by a AND processing, a NOT processing, a NAND processing, and a time delay processing.

2. The TFT-LCD driving circuit according to claim 1, wherein the input terminals include a CPV signal input terminal for inputting the CPV signal, an OE1 signal input terminal for inputting the OE1 signal, an OE2 signal input terminal for inputting the OE2 signal and a STV signal input terminal for inputting the STV signal.

3. The TFT-LCD driving circuit according to claim 2, wherein the output terminals include a CLK signal output terminal for outputting the CLK signal, and a CLKB signal output terminal for outputting the CLKB signal.

4. The TFT-LCD driving circuit according to claim 3, wherein the processing circuit includes a first OR gate, a first NOT gate, a first NAND gate, a first NOR gate, a second NOT gate, a third NOT gate, a fourth NOT gate, a fifth NOT gate, a D flip-flop, a first AND gate, a second AND gate, a third AND gate, and a second OR gate;

input terminals of the first OR gate are connected with the OE1 signal input terminal and the OE2 signal input terminal, respectively;

an input terminal of the first NOT gate is connected with the STV signal input terminal;

input terminals of the first NAND gate are connected with an output terminal of the first OR gate and an output terminal of the first NOT gate, respectively;

input terminals of the first NOR gate are connected to the CPV signal input terminal and an output terminal of the first NAND gate, respectively;

an input terminal of the second NOT gate is connected with the output terminal of the first OR gate;

an input terminal of the third NOT gate is connected with an output terminal of the first NOR gate;

a CP input terminal of the D flip-flop is connected with an output terminal of the third NOT gate;

an input terminal of the fourth NOT gate is connected with the STV signal input terminal, and an output terminal of the fourth NOT gate is connected with a CLRN input terminal of the D flip-flop;

an input terminal of the fifth NOT gate is connected with a Q output terminal of the D flip-flop, and an output terminal of the fifth NOT gate is connected with a D input terminal of the D flip-flop;

input terminals of the first AND gate are connected with an output terminal of the second NOT gate and the output terminal of the fifth NOT gate, respectively, and an output terminal of the first AND gate is connected with the CLK signal output terminal;

input terminals of the second AND gate are connected with the output terminal of the second NOT gate and the Q output terminal of the D flip-flop, respectively;

input terminals of the third AND gate are connected with the STV signal input terminal and the output terminal of the first NOR gate, respectively; and input terminals of the second OR gate are connected with an output terminal of the second AND gate and an output terminal of the third AND gate, respectively, and an output terminal of the second OR gate is connected with the CLKB signal output terminal.

5. The TFT-LCD driving circuit according to claim 1, further comprising an amplifying circuit;

the output terminals for outputting the CLK signal and CLKB signal further include a STVP signal output terminal for outputting a STVP signal and an amplified OE2 signal output terminal for outputting an amplified OE2 signal;

the output terminal of the first AND gate and the CLK signal output terminal are both connected with the amplifying circuit;

the output terminal of the second OR gate and the CLKB signal output terminal are both connected with the amplifying circuit;

the STV signal input terminal and the STVP signal output terminal are both connected with the amplifying circuit; and the OE2 signal input terminal and the amplified OE2 signal output terminal are both connected with the amplifying circuit.

* * * * *